US009284827B2

(12) United States Patent
Canas et al.

(10) Patent No.: US 9,284,827 B2
(45) Date of Patent: Mar. 15, 2016

(54) HYDROCARBON RECOVERY FACILITATED BY IN SITU COMBUSTION

(71) Applicant: Cenovus Energy Inc., Calgary (CA)

(72) Inventors: Christian Canas, Calgary (CA); Simon Gittins, Calgary (CA); Subodh Gupta, Calgary (CA); Arun Sood, Calgary (CA); Xinjie Wu, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 14/283,882

(22) Filed: May 21, 2014

(65) Prior Publication Data

US 2014/0345859 A1 Nov. 27, 2014

Related U.S. Application Data

(60) Provisional application No. 61/827,503, filed on May 24, 2013.

(51) Int. Cl.
*E21B 43/24* (2006.01)

(52) U.S. Cl.
CPC ..... *E21B 43/2408* (2013.01)

(58) Field of Classification Search
CPC ... E21B 43/24; E21B 43/243; E21B 43/2401; E21B 43/16; E21B 43/40
USPC ..... 166/256, 260, 266, 272.1
See application file for complete search history.

(56) References Cited

U.S. PATENT DOCUMENTS 4,116,275 A 9/1978 Butler
4,344,485 A 8/1982 Butler (Continued)

FOREIGN PATENT DOCUMENTS

CA 1304287 6/1992
CA 1304287 C 6/1992

(Continued)

OTHER PUBLICATIONS

U.S. Appl. No. 14/276,722, filed May 13, 2014, Bell et al.
U.S. Appl. No. 14/327,446, filed Jul. 9, 2014, Gittins et al.

*Primary Examiner* — Doug Hutton, Jr.
*Assistant Examiner* — Silvana Runyan
(74) *Attorney, Agent, or Firm* — Knobbe Martens Olson & Bear LLP

(57) ABSTRACT

A process for hydrocarbon recovery performs a steam assisted gravity drainage (SAGD) operation by injecting steam in a steam injection well of a SAGD well pair and continuing to inject steam to establish fluid communication between the steam injection well and an oxidizing gas injection well that includes an oxidizing gas injection well segment that is spaced generally above the steam injection well segment, and producing hydrocarbons from a hydrocarbon production well of the SAGD well pair, the hydrocarbon production well including a generally horizontal production well segment disposed generally parallel to and vertically below a generally horizontal steam injection well segment of the steam injection well such that the steam injection well segment is disposed generally vertically between the production well segment and the oxidizing gas injection well segment. In response to determining that the steam injected in the steam injection well reaches the oxidizing gas injection well or is near a top of the oil sands reservoir, SAGD is discontinued and oxidizing gas is injected through an injection well. The oxidizing gas supports in situ combustion (ISC) in the reservoir. During ISC, combustion gases are produced through the steam injection well of the steam assisted gravity drainage well pair; and the mobilized hydrocarbons are recovered from the reservoir through the hydrocarbon production well of the steam assisted gravity drainage well pair.

10 Claims, 20 Drawing Sheets

(56) References Cited

U.S. PATENT DOCUMENTS

| | | | | |
|---|---|---|---|---|
| 5,211,230 | A | 5/1993 | Ostapovich | |
| 6,230,814 | B1 * | 5/2001 | Nasr et al. | 166/400 |
| 7,674,444 | B2 | 3/2010 | Mak | |
| 2009/0260825 | A1 * | 10/2009 | Milam | E21B 36/025 166/303 |
| 2011/0067858 | A1 * | 3/2011 | Dreher et al. | 166/251.1 |
| 2011/0174488 | A1 * | 7/2011 | Morris et al. | 166/305.1 |
| 2012/0205096 | A1 | 8/2012 | Chhina | |
| 2012/0205127 | A1 | 8/2012 | Gittins | |

FOREIGN PATENT DOCUMENTS

| | | |
|---|---|---|
| CA | 2096034 | 11/1994 |
| CA | 2096034 A1 | 11/1994 |
| CA | 2594413 | 7/2006 |
| CA | 2594414 | 7/2006 |
| CA | 2594414 A1 | 7/2006 |
| CA | 2678347 | 2/2010 |
| CA | 2678347 A1 | 2/2010 |
| CA | 2692204 | 8/2010 |

* cited by examiner

HYDROCARBON RECOVERY FACILITATED BY IN SITU COMBUSTION

CROSS REFERENCE TO RELATED APPLICATIONS

This application claims the benefit of priority of U.S. Provisional Patent Application No. 61/827,503 filed May 24, 2013, the disclosure of which is hereby incorporated herein by reference in its entirety.

TECHNICAL FIELD

The present invention relates to a thermal recovery process for recovering viscous hydrocarbons such as heavy oils and bitumen from oil sands deposits that are not susceptible to standard oil well production technologies.

BACKGROUND

A variety of processes are used to recover viscous hydrocarbons, such as heavy oils and bitumen, from oil sands deposits. Extensive deposits of viscous hydrocarbons exist around the world, including large deposits in the Northern Alberta oil sands, that are not susceptible to standard oil well production technologies. One problem associated with producing hydrocarbons from such deposits is that the hydrocarbons are too viscous to flow at commercially relevant rates at the temperatures and pressures present in the reservoir.

In some cases, such deposits are mined using open-pit mining techniques to extract hydrocarbon-bearing material for later processing to extract the hydrocarbons. Alternatively, thermal techniques may be used to heat the oil sands reservoir to mobilize the hydrocarbons and produce the heated, mobilized hydrocarbons from wells. One such technique, utilizing a single horizontal well for injecting heated fluids and producing hydrocarbons, is described in U.S. Pat. No. 4,116,275, which also describes some of the problems associated with the production of mobilized viscous hydrocarbons from horizontal wells.

One thermal method of recovering viscous hydrocarbons using two vertically spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while mobilized hydrocarbons are produced from a lower, parallel, horizontal, production well that is vertically spaced and near the injection well. The injection and production wells are located close to the bottom of the hydrocarbon deposit to collect the hydrocarbons that flow toward the bottom.

The SAGD process is believed to work as follows. The injected steam initially mobilizes the hydrocarbons to create a steam chamber in the reservoir around and above the horizontal injection well. The term "steam chamber" is utilized to refer to the volume of the reservoir that is saturated with injected steam and from which mobilized oil has at least partially drained. As the steam chamber expands upwardly and laterally from the injection well, viscous hydrocarbons in the reservoir are heated and mobilized, in particular, at the margins of the steam chamber where the steam condenses and heats the viscous hydrocarbons by thermal conduction. The mobilized hydrocarbons and aqueous condensate drain, under the effects of gravity, toward the bottom of the steam chamber, where the production well is located. The mobilized hydrocarbons are collected and produced from the production well. The rate of steam injection and the rate of hydrocarbon production may be modulated to control the growth of the steam chamber and ensure that the production well remains located at the bottom of the steam chamber in an appropriate position to collect mobilized hydrocarbons.

In Situ Combustion (ISC) may be utilized to recover hydrocarbons from underground oil sands reservoirs. ISC includes the injection of an oxidizing gas into the porous rock of a hydrocarbon-containing reservoir to ignite and support combustion of the hydrocarbons around the wellbore. ISC may be initiated using an artificial igniter such as a downhole heater or by pre-conditioning the formation around the wellbores and promoting spontaneous ignition. The ISC process, also known as fire flooding or fireflood, is sustained and the ISC fire front moves due to the continuous injection of the oxidizing gas. The heat generated by burning the heavy hydrocarbons in place produces hydrocarbon cracking, vaporization of light hydrocarbons and reservoir water in addition to the deposition of heavier hydrocarbons known as coke. As the fire moves, the burning front pushes a mixture of hot combustion gases, steam, and hot water, which in turn reduces oil viscosity and the oil moves toward the production well. Additionally, the light hydrocarbons and the steam move ahead of the burning front, condensing into liquids, facilitating miscible displacement and hot waterflooding, which contribute to the recovery of hydrocarbons.

Canadian Patent 2,096,034 to Kisman et al. and U.S. Pat. No. 5,211,230 to Ostapovich et al. disclose in-situ combustion for the recovery of hydrocarbons from underground reservoirs. The disclosed processes include gravity drainage to a basal horizontal well in a combustion process. A horizontal production well is located in the lower portion of the reservoir. A vertical injection and one or more vertical vent wells are provided in the upper portion of the reservoir. Oxygen-enriched gas is injected down the injector well and ignited in the upper portion of the reservoir to create a combustion zone that reduces viscosity of oil in the reservoir as the combustion zone advances downwardly toward the horizontal production well. The reduced-viscosity oil drains into the horizontal production well under the force of gravity.

Canadian Patent 2,678,347 to Bailey discloses a pre-ignition heat cycle (PIHC) using cyclic steam injection and steam flood methods that improve the recovery of viscous hydrocarbons from a subterranean reservoir using an overhead in-situ combustion process, referred to as combustion overhead gravity drainage (COGD). The PIHC is utilized to precondition the reservoir by developing a combustion chamber. Bailey discloses a method where the reservoir well network includes one or more injection wells and one or more vent wells located in the top portion of the reservoir, and where the horizontal drain is located in the bottom portion of the reservoir.

The use of ISC as a follow up process to SAGD is disclosed in Canadian Patent 2,594,414 to Chhina et al. The disclosed hydrocarbon recovery processes may be utilized in oil sands reservoirs. Chhina discloses a process where a former steam injection well, used during the preceding SAGD recovery process, is used as an oxidizing gas injection well and where another former steam injection well, adjacent to the oxidizing gas injection well, is converted into a combustion gas production well. This results in the horizontal hydrocarbon production well being located below the horizontal oxidizing gas injection well and at least one combustion gas production well being spaced from the injection well by a distance that is greater than the spacing between hydrocarbon production well and the oxidizing gas injection well. Since the process disclosed by Chhina uses at least two wells pairs, ISC is initiated after the production well is sufficiently depleted of hydrocarbons to establish communication between the two well pairs.

Improvements in the recovery of viscous hydrocarbons, such as heavy oils and bitumen, from oil sands deposits are desirable.

SUMMARY

According to an aspect of an embodiment, a process for hydrocarbon recovery from an oil sands deposit is provided. The process includes injecting an oxidizing gas into an oil sands reservoir through an oxidizing gas injection well that includes an oxidizing gas injection segment. The oxidizing gas supports in situ combustion in the reservoir. The process also includes utilizing a generally horizontal well pair that is in fluid communication with the oxidizing gas injection well to recover hydrocarbons mobilized by the in situ combustion. The generally horizontal well pair includes a generally horizontal segment of a hydrocarbon production well, and a generally horizontal segment of combustion gas production well. The generally horizontal well pair is utilized by producing combustion gases through the combustion gas production well, and recovering the mobilized hydrocarbons from the reservoir through the hydrocarbon production well. The generally horizontal segment of the combustion gas production well is generally parallel to and spaced generally vertically above the horizontal segment of the hydrocarbon production well, and the injection segment of the oxidizing gas injection well is spaced generally above from the segment of the hydrocarbon production well and generally above the segment of the combustion gas production well.

BRIEF DESCRIPTION OF THE DRAWINGS

Embodiments of the present invention will be described, by way of example, with reference to the drawings and to the following description, in which.

DETAILED DESCRIPTION

Figure 1:
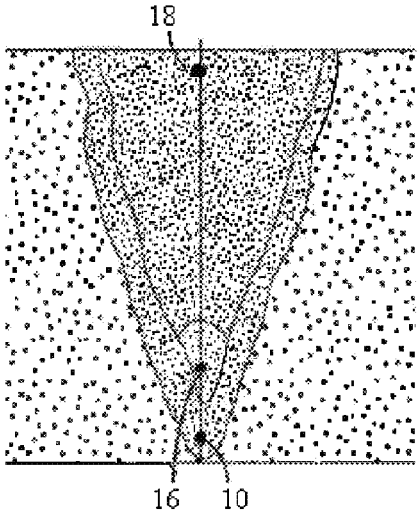
FIG. 1 is a sectional view through a reservoir, illustrating a SAGD well pair and oxidizing gas injection well utilized for ISC in accordance with an embodiment.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Heavy oil recovery techniques, such as SAGD, create mobile zone chambers in an oil sands reservoir, from which at least some of the original oil-in-place has been recovered. Steam injection methods such as cyclic-steam stimulation (CSS) and steam assisted gravity drainage (SAGD) are, to date, the most successful in situ heavy oil and bitumen recovery methods. However, continued improvements and reduction in steam to oil ratio (SOR) are desirable.

In situ combustion has been used in combination with steam-based recovery to reduce the overall SOR. However, in viscous heavy oil reservoirs, such as oil sands reservoirs, lack of sufficient fluid mobility inhibits the injection of the oxidizing gas into the reservoir at sufficiently high rate to create the conditions for ignition and propagation of a combustion front.

The disclosure generally relates to a process for hydrocarbon recovery from an oil sands deposit. The process includes injecting an oxidizing gas into an oil sands reservoir through an oxidizing gas injection well that includes an oxidizing gas injection segment. The oxidizing gas supports in situ combustion in the reservoir. The process also includes utilizing a generally horizontal well pair that is in fluid communication with the oxidizing gas injection well to recover hydrocarbons mobilized by the in situ combustion. It is necessary to have fluid communication between the oxidizing gas injection well and the production well to allow ignition and propagation of the combustion front. The generally horizontal well pair includes a generally horizontal segment of a hydrocarbon production well, and a generally horizontal segment of combustion gas production well. The generally horizontal well pair is utilized by producing combustion gases through the combustion gas production well, and recovering the mobilized hydrocarbons from the reservoir through the hydrocarbon production well. The generally horizontal segment of the combustion gas production well is generally parallel to and spaced generally vertically above the horizontal segment of the hydrocarbon production well, and the injection segment of the oxidizing gas injection well is spaced generally above from the segment of the hydrocarbon production well and generally above the segment of the combustion gas production well.

The oxidizing gas injection well may be a generally horizontal well, a generally vertical well, or a generally inclined well. The oxidizing gas injection well may have a combination of different segments which are independently generally vertical, generally inclined, or generally horizontal. The oxidizing gas injection well preferably injects the oxidizing gas along the length of the generally horizontal well pair used for hydrocarbon production and combustion gas production. This may be accomplished, for example, by using a generally horizontal oxidizing gas injection well that is parallel to one or both of the generally horizontal well pair used for hydrocarbon production and combustion gas production; or by using a plurality of vertical oxidizing gas injection wells aligned along the length of the generally horizontal well pair used for hydrocarbon production and combustion gas production.

The hydrocarbon production well and the combustion gas production well may be from a former oil sands production well pair, where a former mobility enhancing well is used as the combustion gas production well. The term "mobility enhancing well" would be understood to refer to a well which is used to provide a mobility enhancer, such as heat, solvent, or both, to promote the movement of the hydrocarbons toward the production well. Examples of a mobility enhancer include: steam, hot water, methane, hydrocarbon solvents, a heat source, or combinations thereof. Examples of an oil sands production well pair include: a SAGD well pair, a cyclic-steam stimulation well pair.

Exemplary processes according to the present disclosure may allow ISC to be first initiated when the amount of recoverable hydrocarbons is greater than the amount of recoverable hydrocarbons available to a process where post-SAGD in situ combustion is used with at least two horizontally spaced SAGD well pairs and the post-SAGD in situ combustion process is first initiated only once the two well pairs are fluidly connected, such as disclosed in Canadian Patent 2,594,414 to Chhina et al. That is, when compared to the process disclosed by Chhina, exemplary processes according to the present disclosure may reduce the overall steam to oil ratio required to recover the hydrocarbons available in an oil sands deposit.

In one specific example according to the present disclosure, the process uses: an oil sands reservoir that is preconditioned by a steam-assisted hydrocarbon recovery process, such as SAGD, to establish a depleted steam chamber, and an oxidizing gas injection well having an oxidizing gas injection segment that is at least in part located in the depleted steam chamber. When the oxidizing gas injection segment is located at least in part in the depleted steam chamber, the oxidizing gas injection well is in fluid communication with the steam-assisted hydrocarbon recovery well pair. In the specific example, the oxidizing gas injection well is generally horizontal and the segment of the oxidizing gas injection well near a top of the reservoir is spaced generally above the hydrocarbon production well and the former steam injection well that is used as the combustion gas production well.

In this example, prior to ISC, a steam-assisted hydrocarbon recovery process, such as SAGD is performed in the hydrocarbon reservoir. A well pair, including hydrocarbon production well and a steam injection well are utilized in the SAGD process. One example of a well pair is illustrated in FIG. 1. The hydrocarbon production well includes a generally horizontal segment 10 that extends near the base or bottom 12 of the hydrocarbon reservoir 14. The steam injection well also includes a generally horizontal segment 16 that is disposed generally parallel to and is spaced generally vertically above the horizontal segment 10 of the hydrocarbon production well. The generally horizontal segment 16 of the steam injection well may be, for example, about 2 to 10 meters apart from the generally horizontal segment 10 of the hydrocarbon production well. In the simulations discussed below, the two segments are 4 meters apart.

During SAGD, steam is injected into the steam injection well to mobilize the hydrocarbons and create a steam chamber in the reservoir, around and above the generally horizontal segment 16. In addition to steam injection into the steam injection well, light hydrocarbons, such as C3 through C10 alkanes, may optionally be injected with the steam. The volume of light hydrocarbons that are injected is relatively small compared to the volume of steam injected. The addition of light hydrocarbons is referred to as a solvent-assisted process (SAP). The SAGD or SAP processes may also be augmented or enhanced by inclusion of other substances, such as non-condensing gases and surfactants. Viscous hydrocarbons in the reservoir are heated and mobilized and the mobilized hydrocarbons drain, under the effects of gravity. The mobilized hydrocarbons are collected in the horizontal segment 10 and produced from the hydrocarbon production well.

In addition to the well pairs that are utilized in the SAGD process, an oxidizing gas injection well is preferably located such that an oxidizing gas injection segment is located near a top of the reservoir. The oxidizing gas injection well preferably extends generally horizontally near a top of the reservoir, as illustrated in FIG. 1. For example, the segment 18 may extend less than 10 meters below the top of the reservoir, or reservoir overburden. The generally horizontal segment 18 of the oxidizing gas injection well is generally above the generally horizontal segment 10 of the hydrocarbon production well and generally above the generally horizontal segment 16 of the steam injection well. The vertical distance between the generally horizontal segment 18 of the oxidizing gas injection well and the generally horizontal segment 16 of the steam injection well is greater than the vertical spacing between the generally horizontal segment 16 of the steam injection well and the generally horizontal segment 10 of the hydrocarbon production.

Figure 2:
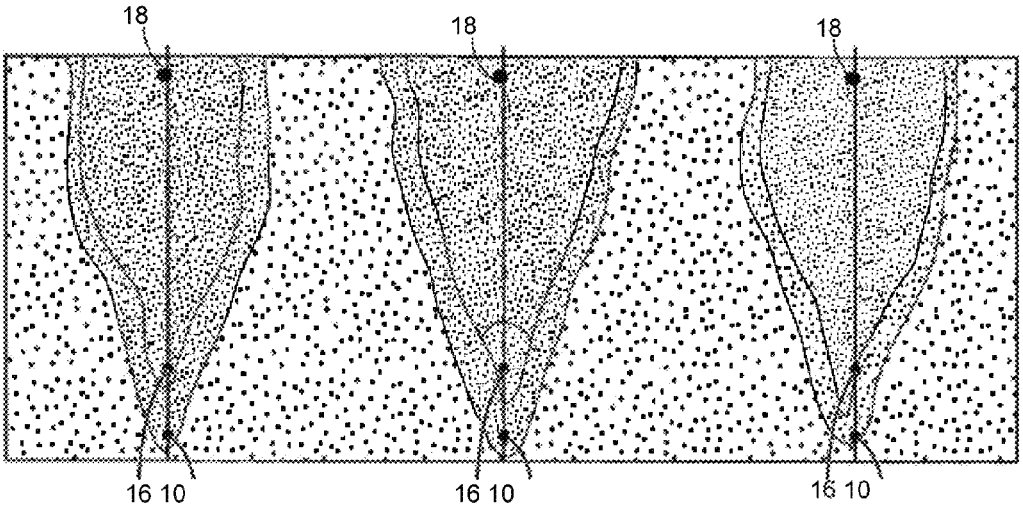
FIG. 2 is a sectional view through a reservoir, illustrating a plurality of SAGD well pairs and oxidizing gas injection wells utilized for ISC in accordance with an embodiment.

As illustrated in FIGS. 1 and 2, the generally horizontal segment 18 is located such that the segment 18 extends generally parallel to and directly vertically above the generally horizontal segments 16 of steam injection well. However, it should be understood that the generally horizontal segment 18 may be located such that the segment 18 is generally vertically above, but does not extend directly above, the generally horizontal segments 16 of steam injection well. For example, an oxidizing gas injection well may be disposed generally vertically above and between two SAGD well pairs, reducing the number of oxidizing gas injection wells utilized. It would be understood that an oxidizing gas injection well could provide oxidizing gas to mobilize hydrocarbons that are produced through more than one hydrocarbon production well.

It would be understood that an oxidizing gas injection well being disposed "generally vertically above" or "generally above" a steam injection well refers to the injection segment of an oxidizing gas injection well being less than 75° from a vertical line extending through the steam injection well. In particular embodiments, the injection segment of an oxidizing gas injection well is less than about 60° from the vertical line. In preferred embodiments, the injection segment of an oxidizing gas injection well is less than about 45° from the vertical line. The terms "directly vertically above" and "directly above" refer to embodiments where the injection segment of an oxidizing gas injection well is less than about 5° from a vertical line extending through the steam injection well. The terms would similarly denote the spatial relationship of any other two wells.

A plurality of well pairs may be utilized at spaced-apart locations in the reservoir and a corresponding plurality of oxidizing gas injection wells may be utilized, as shown in FIG. 2. In this example, three SAGD well pairs and three generally horizontal segments 18 of oxidizing gas injection wells are utilized. The plurality of well pairs may be spaced 40 to 150 meters apart. In the simulations discussed below, the pair of SAGD well pairs are spaced 100 meters apart. FIG. 2 illustrates, therefore, three generally horizontal segments 10 of hydrocarbon production wells, three generally horizontal segments 16 of steam injection wells, and three generally horizontal segments 18 of oxidizing gas injection wells, where the segments 18 extend generally parallel to and directly vertically above the generally horizontal segments 16 of the steam injection wells. However, it should be understood it is not necessary to match the number of oxidizing gas injection wells to the number of steam injections wells. For example, two generally horizontal segments of oxidizing gas injection wells may be disposed generally above and between three SAGD well pairs.

It is preferable to drill the oxidizing gas injection well prior to the steam chamber reaching the oxidizing gas injection well in order to avoid drilling through high temperature, high pressure reservoir. For example, the oxidizing gas injection well may be drilled when the SAGD well pair is drilled, after drilling the SAGD well pair, or prior to drilling the SAGD well pair. If the oxidizing gas injection well is to be positioned directly above the SAGD well pair, it is preferable to drill the oxidizing gas injection well before or when the SAGD well pair is drilled. If the oxidizing gas injection well is to be positioned between two SAGD well pairs so that it is laterally offset, the oxidizing gas injection well may be drilled before, during or after the SAGD well pair is drilled.

According to the present embodiment, SAGD is performed for a period of time until the steam injected through the steam injection well reaches the oxidizing gas injection well. Depending on where the oxidizing gas injection well is drilled, SAGD may be performed until the injected steam reaches or is near the top of the reservoir. Sensors such as pressure and temperature sensors located in the steam injection well, in the hydrocarbon production well, in the oxidizing gas injection well, or any combination thereof, may be utilized to detect that the steam injected is at or near the top of the reservoir. Alternatively or additionally, observation wells drilled into the reservoir may be utilized to determine that the steam injected is at or near the top of the reservoir. Steam front monitoring may also be utilized to determine that the steam injected is at or near the top of the reservoir.

Prior to ignition to start ISC in the oxidizing gas injection well, steam may be injected into the oxidizing as injection wellbore to remove liquid hydrocarbons surrounding the wellbore. This injected steam raises the temperature of part of the reservoir, for example, to about 150° C. Alternatively, a volatile oil mixture may be added to the formation and then displaced by steam injection followed by injection of a non-condensing gas, for example nitrogen. For example, steam may be injected for about one day, followed by nitrogen injection for about one day. The steam, or steam and subsequent nitrogen, is used to reduce the amount of combustible materials from the immediate vicinity of the oxidizing gas injection wellbore and thereby reduce high temperature exposure and consequent damage to the steel.

ISC is then carried out by injecting an oxidizing gas through the oxidizing gas injection well. The oxidizing gas may be injected continuously for continuous combustion. Combustion may be initiated utilizing an artificial igniter, such as a downhole heater, or by using spontaneous ignition. The oxidizing gas that is injected may be, for example, air, enriched air, diluted air, or any other suitable gas including oxygen. The in situ combustion may be managed to mobilize hydrocarbons in the heavy oil by controlling: the rate, the pressure, or both of oxidizing gas injected through the oxidizing gas injection well; the rate, the pressure, or both of production of combustion gases from the former steam injection well; the rate, the pressure, or both of hydrocarbon production from the hydrocarbon production well; or any combination thereof.

Optionally, water may be injected with the oxidizing gas, resulting in a wet combustion process. This may facilitate the flow of heated hydrocarbons to the hydrocarbon production well as the generated steam promotes heat transfer in the oil sands reservoir.

As the oxidizing gas is injected through the oxidizing gas injection well and into the reservoir, the resulting combustion gases are produced from the former steam injection well, now the combustion gas production well, as the combustion gases are driven into the generally horizontal segment 16 of the steam injection well. The hydrocarbons that are mobilized as a result of the combustion process drain to the generally horizontal segment 10 and are recovered through the hydrocarbon production well. Thus, the steam injection well and the hydrocarbon production well utilized in the SAGD process are utilized in the ISC process to collect the combustion gases and to produce the mobilized hydrocarbons, respectively. Advantageously, the SAGD well pair is re-utilized and further combustion gas production wells or further hydrocarbon production wells, beyond the well pair or well pairs utilized for SAGD and any wells, such as infill producers, which may have been added as concurrent supplements to the SAGD process, are not required for the ISC.

Because the steam injection well, which is utilized for gas production, is located generally below the oxidizing gas injection well, fluid communication between the oxidizing gas injection segment of the oxidizing gas injection well and the generally horizontal segment 16 of the steam injection well is established earlier in the SAGD process than fluid communication is established between steam injection and oxidizing gas injection wells in processes where the steam injection well is laterally spaced from or above the oxidizing gas injection segment of the oxidizing gas injection well. This is because steam preferentially rises to heat the upper part of the reservoir, creating a steam chamber that forms more quickly in an upwardly direction and results in fluid communication with an oxidizing gas injection well that is above the steam injection well, when compared to a steam injection well that is laterally spaced from or that is above the oxidizing gas injection segment.

A benefit to positioning the combustion gas production well generally below the oxidation gas injection well, and utilizing a combustion gas production well that is separate from a hydrocarbon production well, is that the hydrocarbons that are produced are separated from the combustion gases downhole, thereby reducing the chance of oxidizing gas and combustion gases communicating with the hydrocarbon production well. That is, it reduces the chance that oxidizing gases, combustion gases, or both will escape via the hydrocarbon production well. This reduction may result in the combustion front being more easily controlled. This reduction may additionally reduce high volumes of combustion gases flowing into the hydrocarbon production well, which could restrict the flow of hydrocarbons into the hydrocarbon production well. Corrosion of metals, such as well tubes, and other well apparatus, may be mitigated and surface facilities design may be facilitated as the gases and hydrocarbons are substantially separated downhole.

The ISC that is carried out, referred to as top-down in-situ combustion, takes advantage of gravity segregation between the oxidizing gas and the liquids, including the hydrocarbons. By virtue of the density difference between gases and liquids, the liquids, including the hydrocarbons, tend to accumulate in the lower portion of the chamber, inhibiting fingering of the oxidizing gas into the hydrocarbon production wells. The oxidizing gas is generally consumed at the combustion front. Thus, travel of oxidizing gas ahead of the combustion front, into a colder region of the chamber, is inhibited. This is beneficial as travel of oxidizing gas ahead of the combustion front may induce low temperature oxidation reactions and cause blocking problems in the reservoir. A "blocking problem" would be understood to refer to non-mobile oil blocking the movement of oxidizing gases to the combustion front.

Although the above example discusses a steam-assisted hydrocarbon recovery process, and specifically SAGD, being carried out before ISC, it should be understood that mobility enhancing processes other than steam-assisted recovery may be used. For example, hot water, methane, hydrocarbon solvents, a heat source, or combinations thereof may alternatively be used to establish fluid communication between the oxidizing gas injection well and the hydrocarbon recovery well pair.

EXAMPLES

Figure 3:
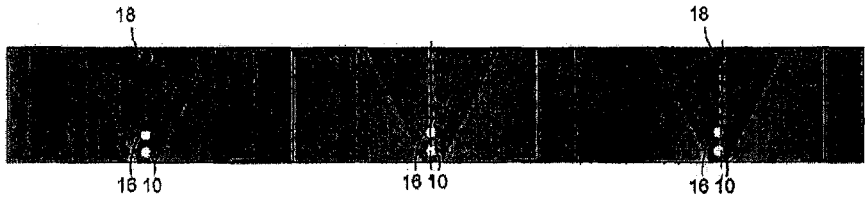
FIG. 3 is a section view through a reservoir, illustrating three SAGD well pairs and two oxidizing gas injection wells utilized for ISC in accordance with an embodiment.

A computer simulation was run to model an oil sands recovery process where three SAGD well pairs and two oxidizing gas injection wells were used to recover hydrocarbons. In the simulation, the two oxidizing gas injection wells were located directly vertically above the first and the third SAGD well pairs. The configuration is illustrated in FIG. 3, which illustrates oxidizing gas injection wells 18 and SAGD well pairs 10 and 16. The dashed lines indicate the left and right boundaries of the modeled system. The illustrated modeled system shows the oxidizing gas injection well being in fluid communication with the SAGD well pair that is below the oxidizing gas injection well, but not in fluid communication with any of the other SAGD well pairs.

The modeled system included 635.85 $m^3$ of Original Oil in Place (OOIP) and day 0 was arbitrary set to be Jan. 1, 2000. Steam assisted gravity drainage was modeled as running until day 915 (2.5 years, Jul. 4, 2002), where the process resulted in:

Cumulative heat loss to adjacent formations: 2.30e8 kJ
Cumulative energy injected: 1.59e9 kJ
Cumulative energy produced: 7.34e9 kJ
Energy accumulated in the reservoir: 6.24e9 kJ
Cumulative Produced water: 590.874 $m^3$
Cumulative Produced bitumen: 264.84 $m^3$
Recovery Factor (RF): 41.65%

In situ combustion was modeled with an average air injection rate of 173.48 $m^3$/day and running until day 4565 (12.5 years, Jul. 1, 2012), resulting in cumulative air injection of 633,195 $m^3$. To help improve hydrocarbon production in the hydrocarbon production wells during air injection, the modeled system included a heater in each of the three hydrocarbon production wells. This was done to overcome the temperature decrease in the bitumen in areas surrounding the hydrocarbon production wells.

The equivalent to implementing a heater would be to have some steam injection for a certain period of time followed by a soaking period and subsequent hydrocarbon production. The cumulative energy supplied by these heaters is 1.55e8 kJ, which is about 2.9 times the energy supplied to the reservoir during SAGD start-up. The modeled process resulted in:

Energy generated by combustion: 2.1e9 kJ
Cumulative energy supplied through heaters: 1.55e8 kJ
Cumulative heat loss to adjacent formations: 1.054e9 kJ
Cumulative energy injected: 1.61e9 kJ
Cumulative energy produced: 1.47e9 kJ
Energy accumulated in the reservoir: 1.29e9 kJ
Cumulative produced water: 766.96 $m^3$
Cumulative produced bitumen: 378.06 $m^3$
RF: 59.45%

The process was further modeled until day 5843 (16 years, Dec. 31, 2015), without air injection after day 4565. The modeled process resulted in:

Cumulative heat loss to adjacent formations: 1.319e9 kJ
Cumulative energy injected: 1.61e9 kJ
Cumulative energy produced: 1.51e9 kJ
Energy accumulated in the reservoir: 1.09e9 kJ
Cumulative produced water: 769.94 $m^3$
Cumulative produced bitumen: 477.26 $m^3$
RF: 75.05%

Figure 4:
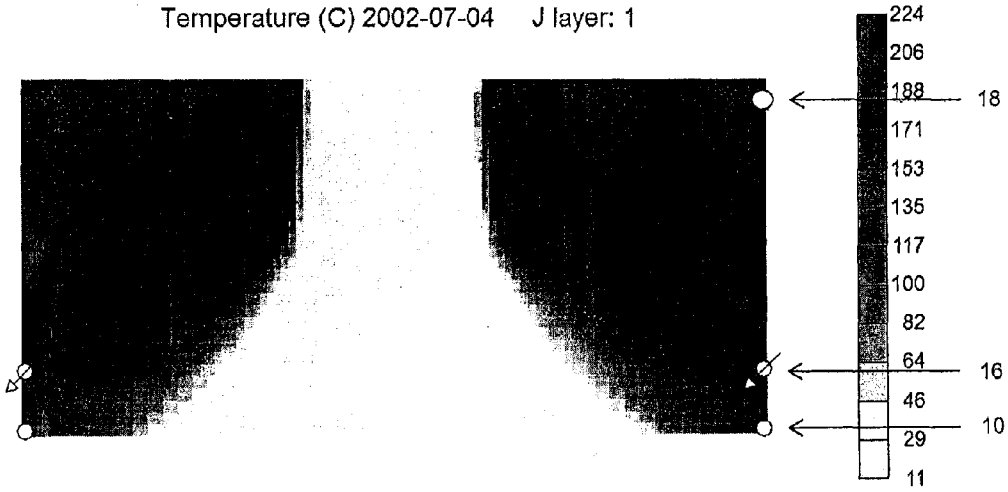
FIG. 4 is a sectional view through the reservoir illustrated in FIG. 3, which shows the temperature after 2.5 years of SAGD.
Figure 5A:
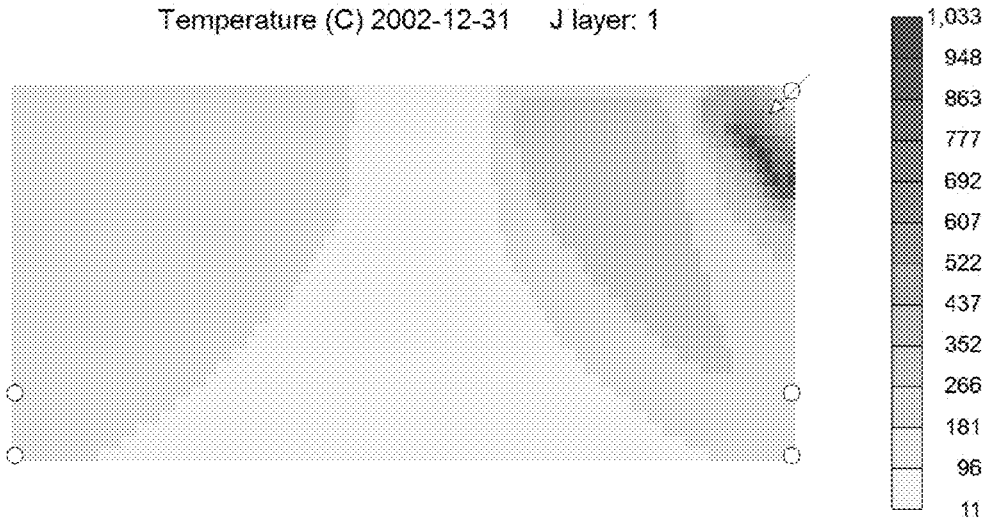
FIGS. 5A and 5B are sectional views through the reservoir illustrated in FIG. 3, which show the temperature and the oil saturation at a specific time during the modeled process.
Figure 5B:
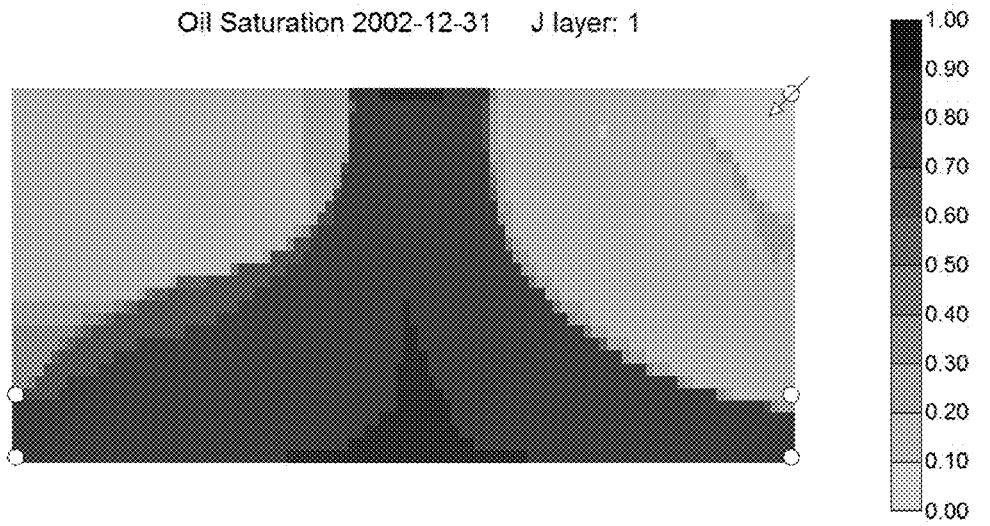
Figure 6A:
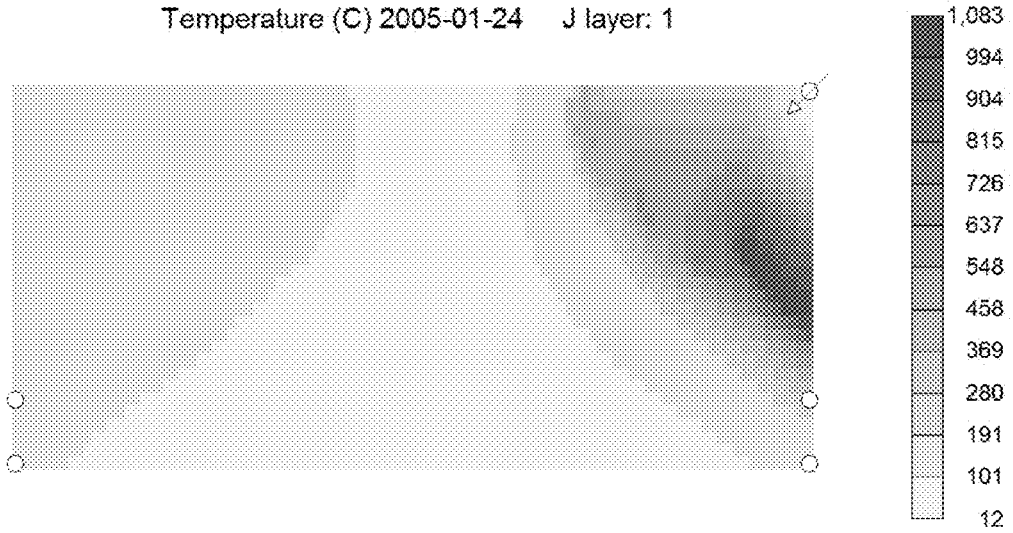
FIGS. 6A and 6B are sectional views through the reservoir illustrated in FIG. 3, which show the temperature and the oil saturation at a specific time during the modeled process.
Figure 6B:
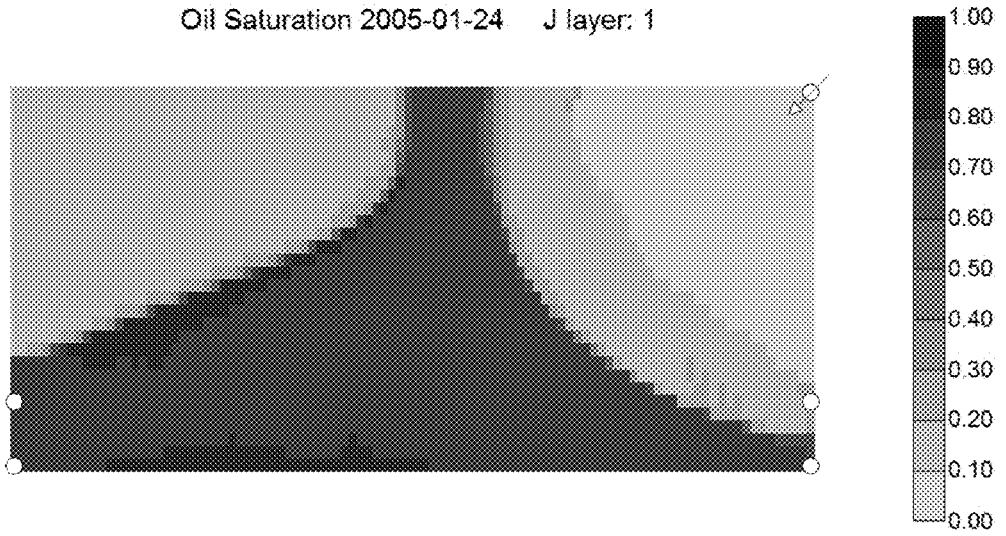
Figure 7A:
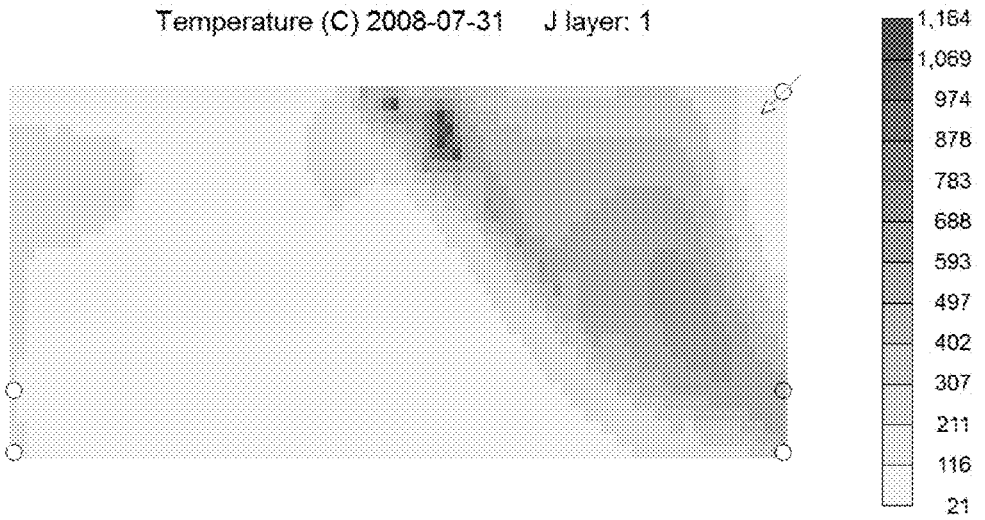
FIGS. 7A and 7B are sectional views through the reservoir illustrated in FIG. 3, which show the temperature and the oil saturation at a specific time during the modeled process.
Figure 7B:
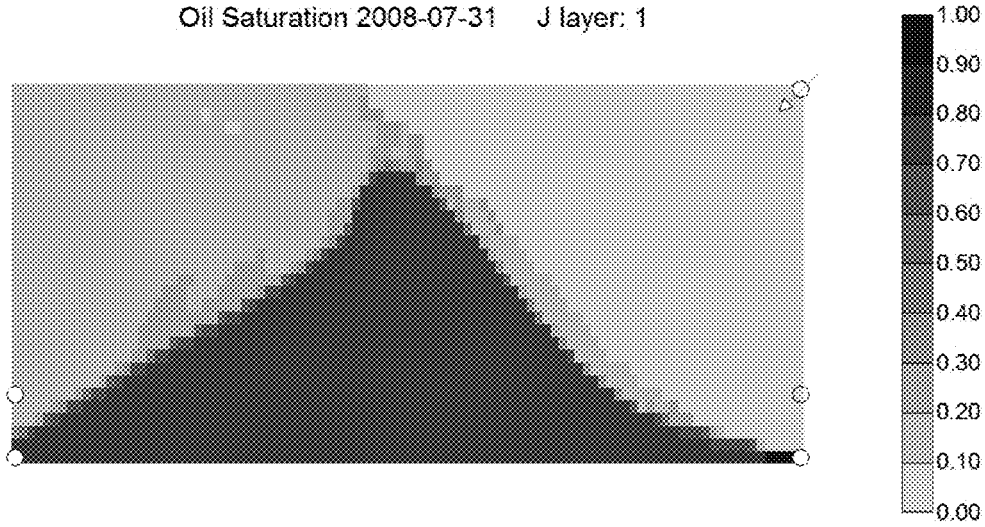
Figure 8A:
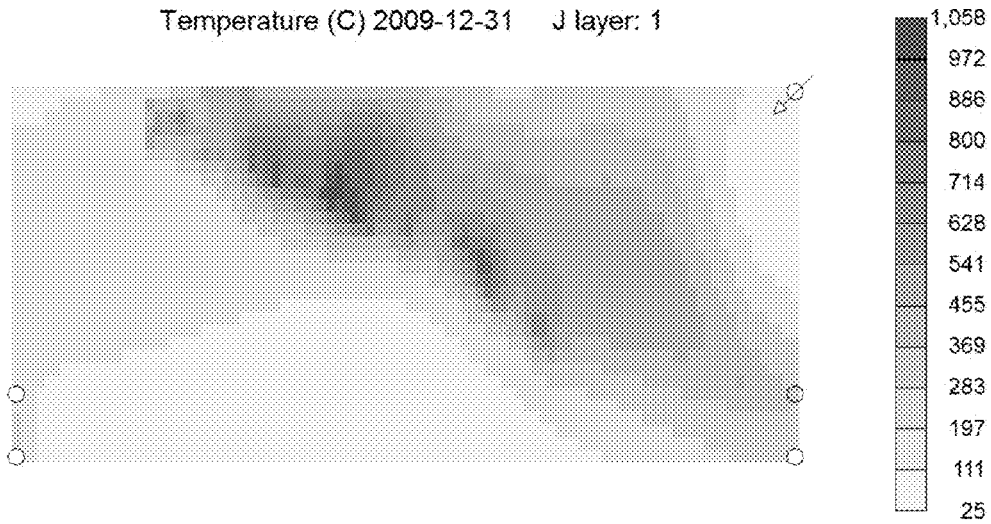
FIGS. 8A and 8B are sectional views through the reservoir illustrated in FIG. 3, which show the temperature and the oil saturation at a specific time during the modeled process.
Figure 8B:
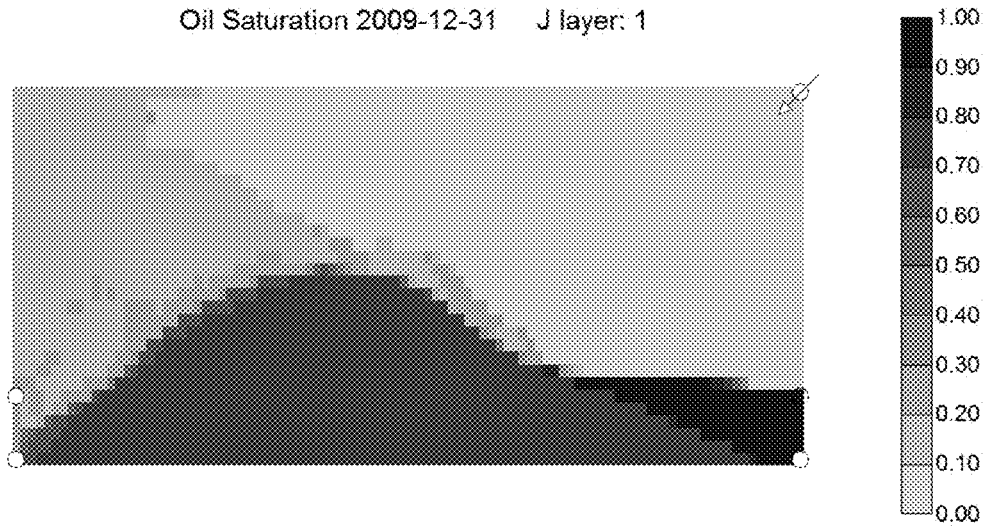
Figure 9A:
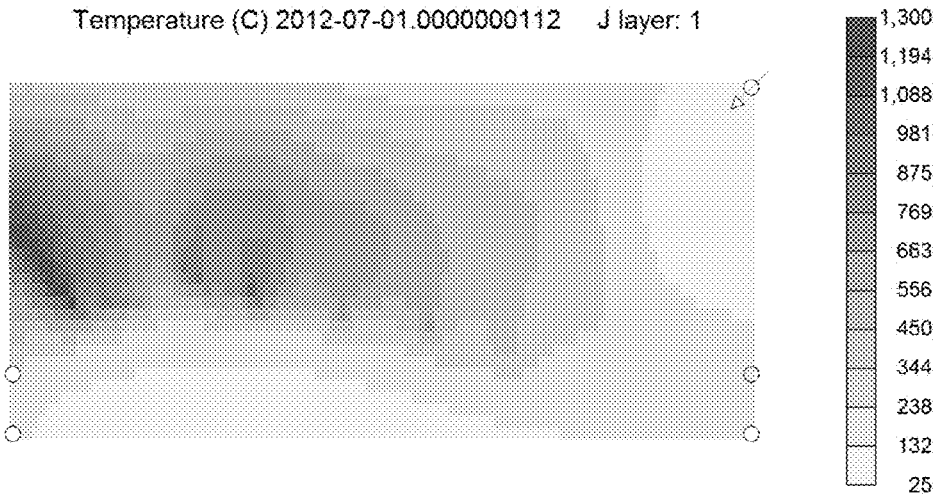
FIGS. 9A and 9B are sectional views through the reservoir illustrated in FIG. 3, which show the temperature and the oil saturation at a specific time during the modeled process.
Figure 9B:
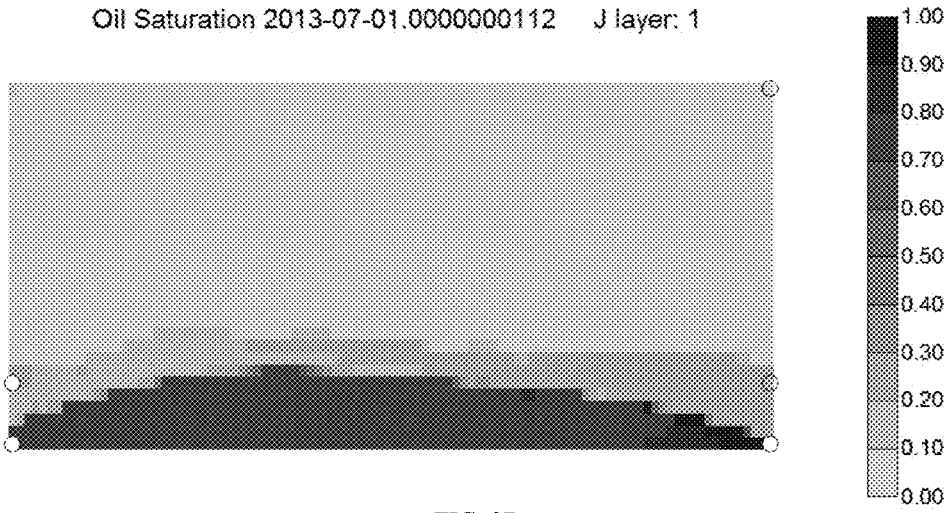
Figure 10A:
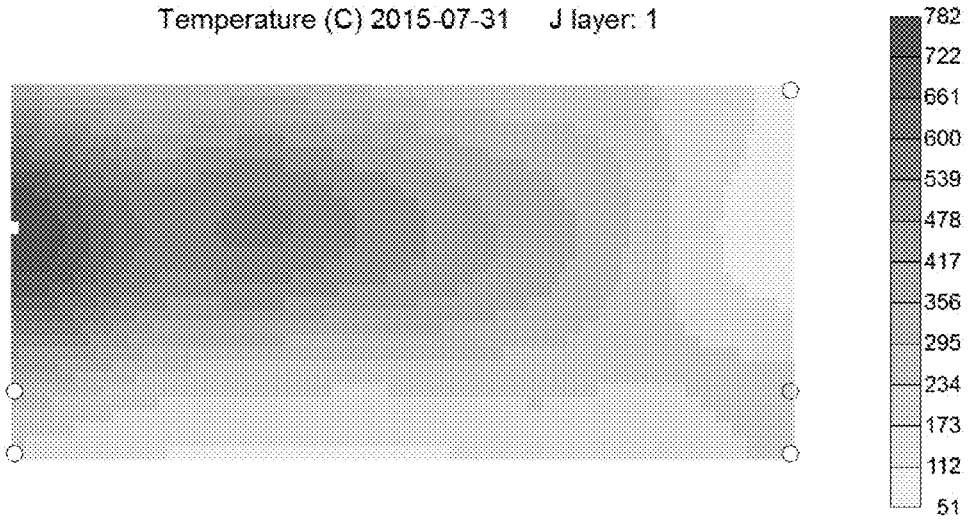
FIGS. 10A and 10B are sectional views through the reservoir illustrated in FIG. 3, which show the temperature and the oil saturation at a specific time during the modeled process.
Figure 10B:
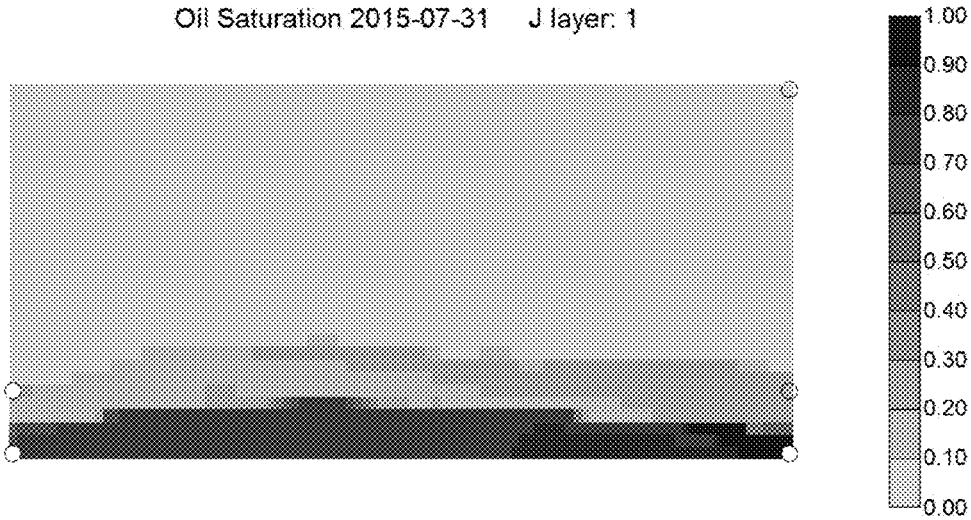

FIG. 4 illustrates the temperature at day 914. FIGS. 5-10 illustrate (A) the temperature and (B) the oil saturation at progressively later times during the simulation (Dec. 31, 2002; Jan. 24, 2005; Jul. 31, 2008; Dec. 31, 2009; Jul. 1, 20012; and Dec. 31, 2015, respectively).

Figure 11:
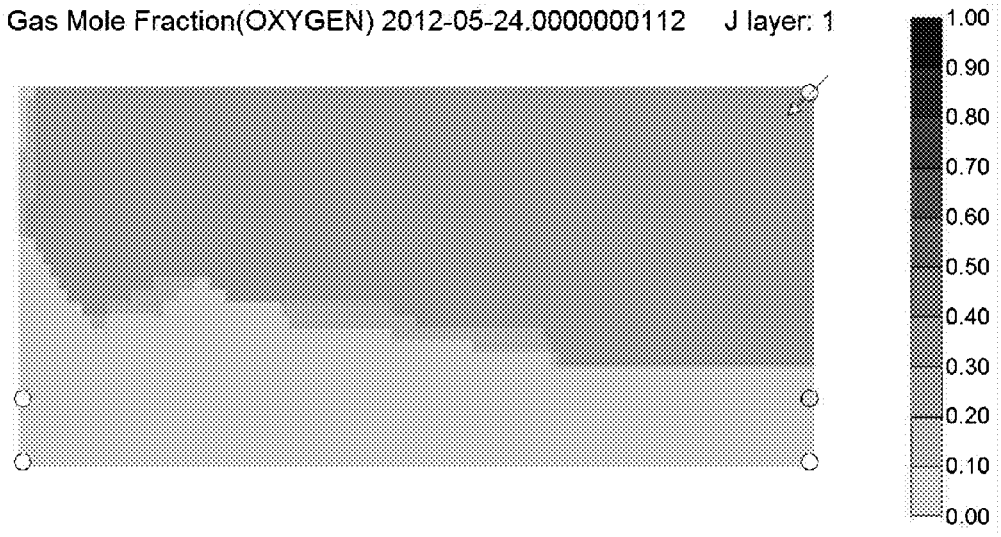
FIG. 11 is a sectional view through the reservoir illustrated in FIG. 3, which shows the gas mole fraction of oxygen after in situ combustion.

FIG. 11 illustrates gas mole fraction of oxygen in the simulation model at the end of the in situ combustion process. The figure illustrates how the air injection is controlled to reduce contact with the hydrocarbon producing wells, reducing the risk of explosions in the well.

Figure 12:
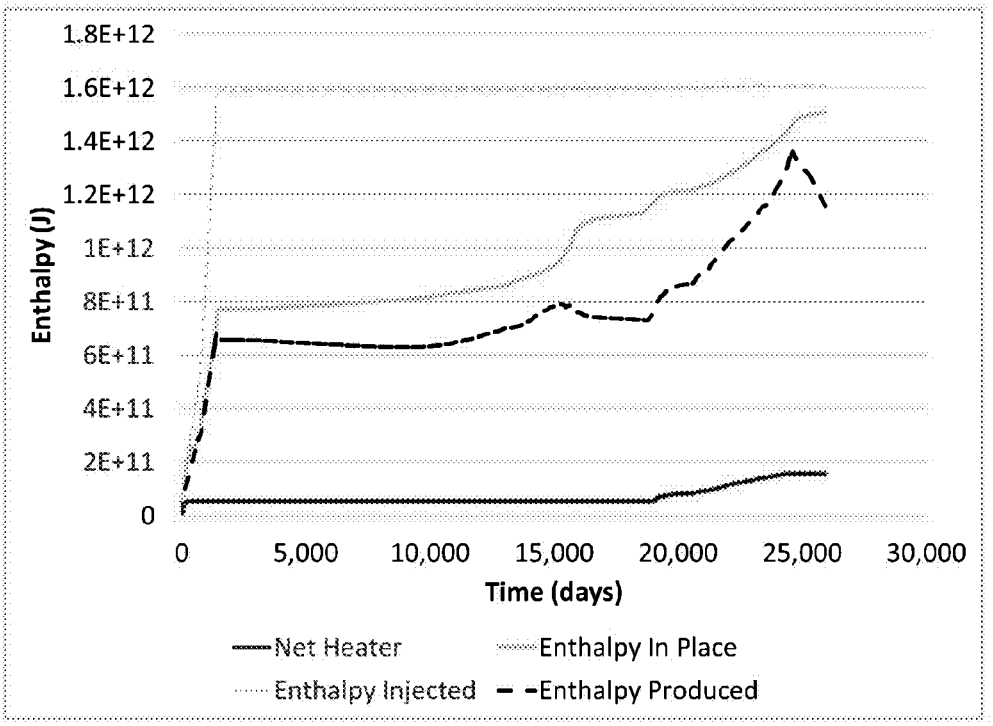
FIG. 12 is a graph showing the cumulative energy injected and produced over time during the modeled process.
Figure 13:
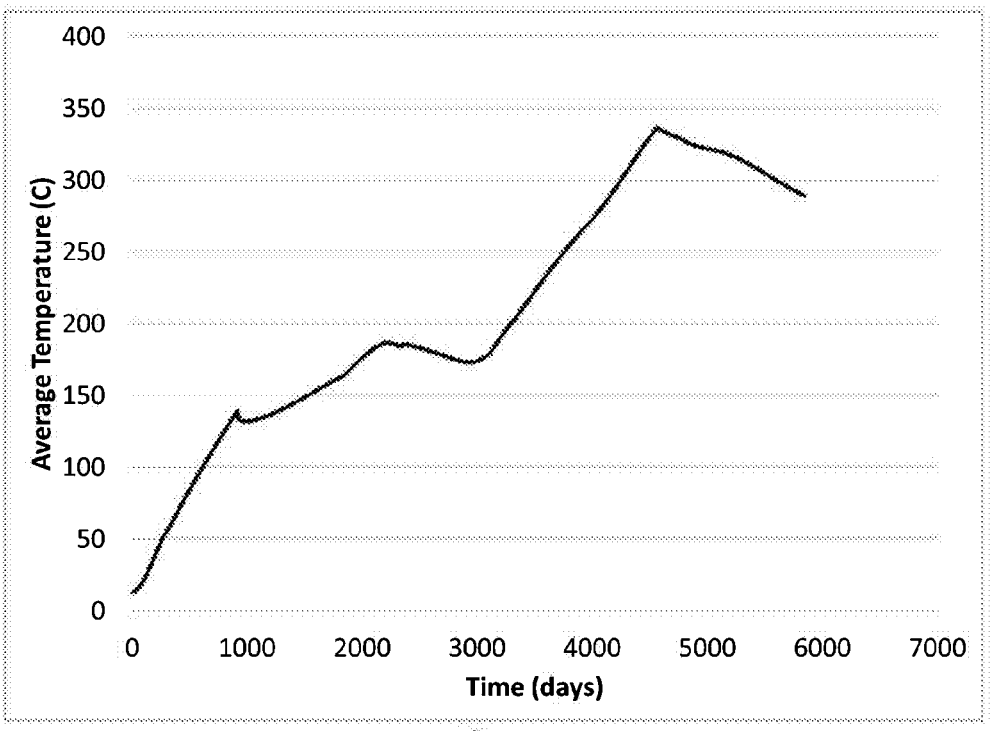
FIG. 13 is a graph showing the average temperature inside the modeled oil sands reservoir over time during the modeled process.
Figure 14:
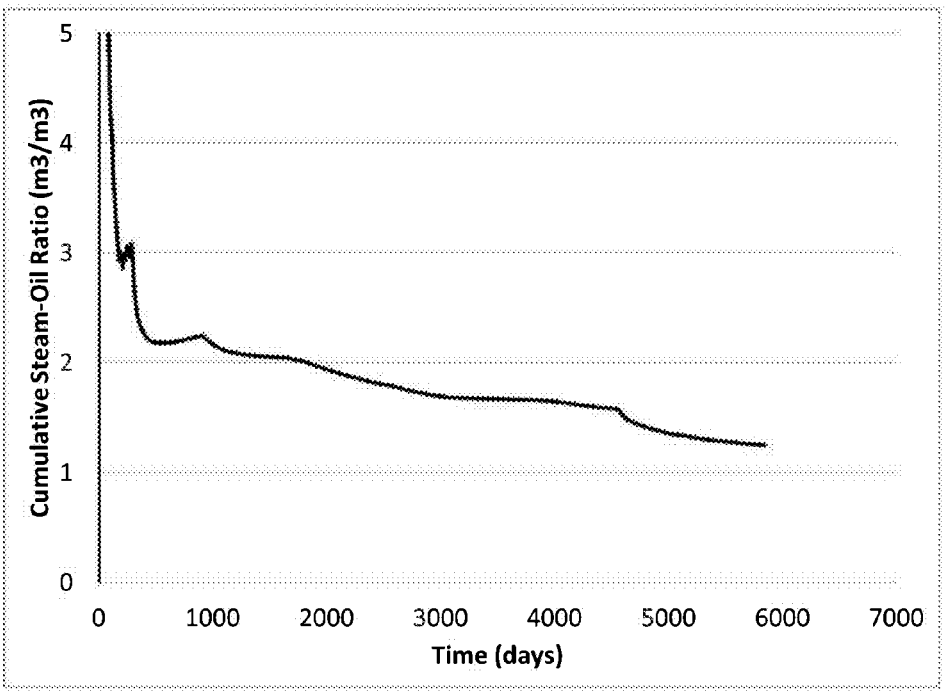
FIG. 14 is a graph showing the steam to oil ratio over time during the modeled process.
Figure 15:
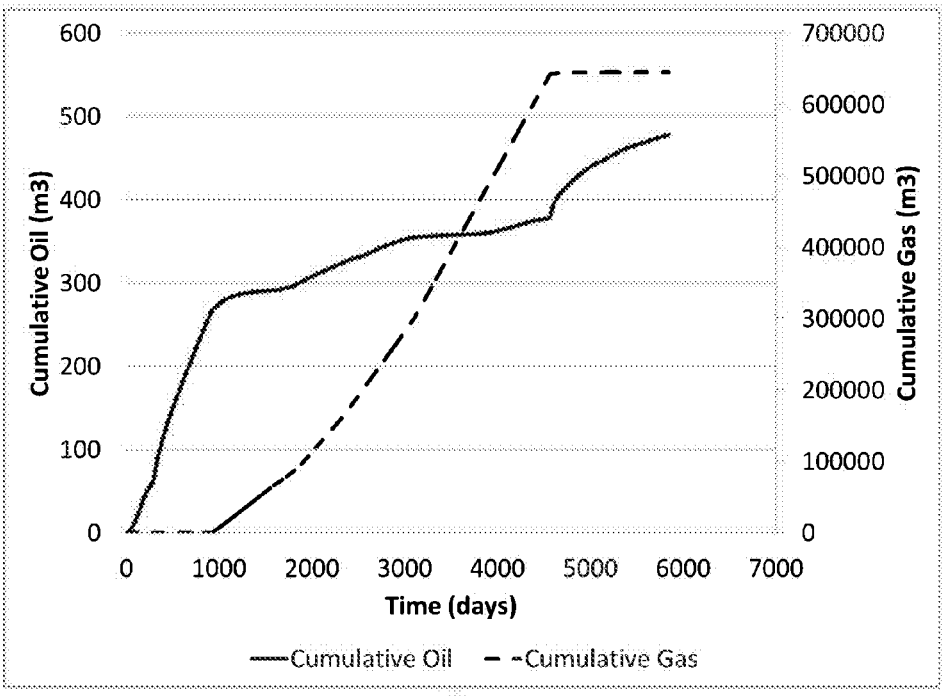
FIG. 15 is a graph showing the percentage of oil recovered from the reservoir.

FIG. 12 is a graph showing the cumulative energy injected and produced over time during the modeled process. The top line is the cumulative enthalpy injected, the second line is the cumulative energy produced, the third line is the enthalpy in place, and the bottom line is the cumulative net heater energy. FIG. 13 is a graph showing the average temperature inside the modeled oil sands reservoir over time during the modeled process. FIG. 14 is a graph showing the steam to oil ratio over time during the modeled process. FIG. 15 is a graph showing the percent of the oil recovered from the reservoir.

A second computer simulation was run to model an oil sands recovery process where three SAGD well pairs and two oxidizing gas injection wells were used to recover hydrocarbons. In this simulation, the two oxidizing gas injection wells were located directly vertically above the first and the third SAGD well pairs. The configuration is illustrated in FIG. 3, which illustrates oxidizing gas injection wells 18 and SAGD well pairs 10 and 16. The dashed lines indicate the left and right boundaries of the modeled system. The illustrated modeled system shows the oxidizing gas injection well being in fluid communication with the SAGD well pair that is below the oxidizing gas injection well, but not in fluid communication with any of the other SAGD well pairs.

The modeled system included 635.85 $m^3$ of Original Oil in Place (OOIP) and day 0 was arbitrary set to be Jan. 1, 2000. Steam assisted gravity drainage was modeled as running until day 1252 (3.4 years), where the process resulted in:

Cumulative heat loss to adjacent formations: 3.96e8 kJ
Cumulative energy injected: 2.17e9 kJ
Cumulative energy produced: 9.63e9 kJ
Energy accumulated in the reservoir: 8.11e9 kJ
Cumulative Produced water: 812.15 $m^3$
Cumulative Produced bitumen: 347.94 $m^3$
Recovery Factor (RF): 54.7%

In situ combustion was modeled with an average air injection rate of 175.85.48 $m^3$/day and running until day 4352 (11.9 years), resulting in cumulative air injection of 545,140 $m^3$. To help improve hydrocarbon production in the hydrocarbon production wells during air injection, the modeled system included a heater in each of the three hydrocarbon production wells. This was done to overcome the temperature decrease in the bitumen in areas surrounding the hydrocarbon production wells.

The equivalent to implementing a heater would be to have some steam injection for a certain period of time followed by a soaking period and subsequent hydrocarbon production. The cumulative energy supplied by these heaters is 1.19e8 kJ, which is about 2 times the energy supplied to the reservoir during SAGD start-up. The modeled process resulted in:

Energy generated by combustion: 2.008e9 kJ
Cumulative energy supplied through heaters: 1.19e8 kJ
Cumulative heat loss to adjacent formations: 1.185e9 kJ
Cumulative energy injected: 2.19e9 kJ
Cumulative energy produced: 1.62e9 kJ
Energy accumulated in the reservoir: 1.35e9 kJ
Cumulative produced water: 995.5 $m^3$
Cumulative produced bitumen: 458.45 $m^3$
RF: 72.1%

The process was further modeled until day 5113 (14 years), without air injection after day 4352. The modeled process resulted in:

Cumulative heat loss to adjacent formations: 1.319e9 kJ
Cumulative energy injected: 2.19e9 kJ
Cumulative energy produced: 1.62e9 kJ
Energy accumulated in the reservoir: 1.35e9 kJ
Cumulative produced water: 996.64 $m^3$
Cumulative produced bitumen: 503.67 $m^3$
RF: 79.02%

Figure 16:
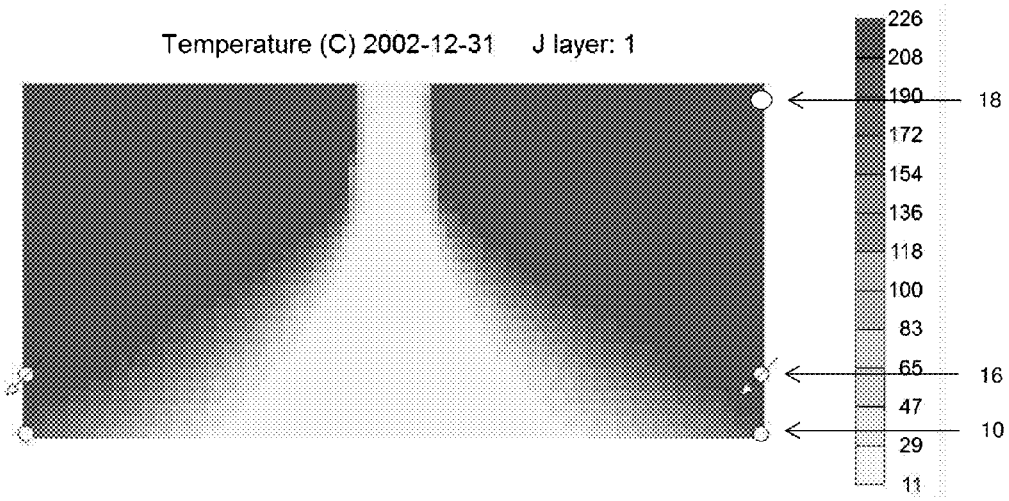
FIG. 16 is a sectional view through the reservoir illustrated in FIG. 3, which shows the temperature after 3 years of SAGD.
Figure 17A:
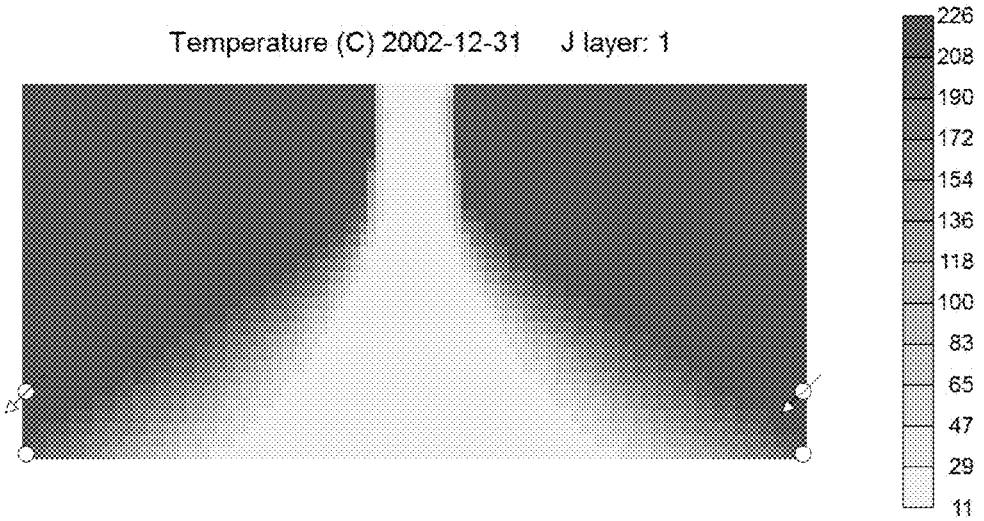
FIGS. 17A and 17B are sectional views through the reservoir illustrated in FIG. 3, which show the temperature and the oil saturation at a specific time during the modeled process.
Figure 17B:
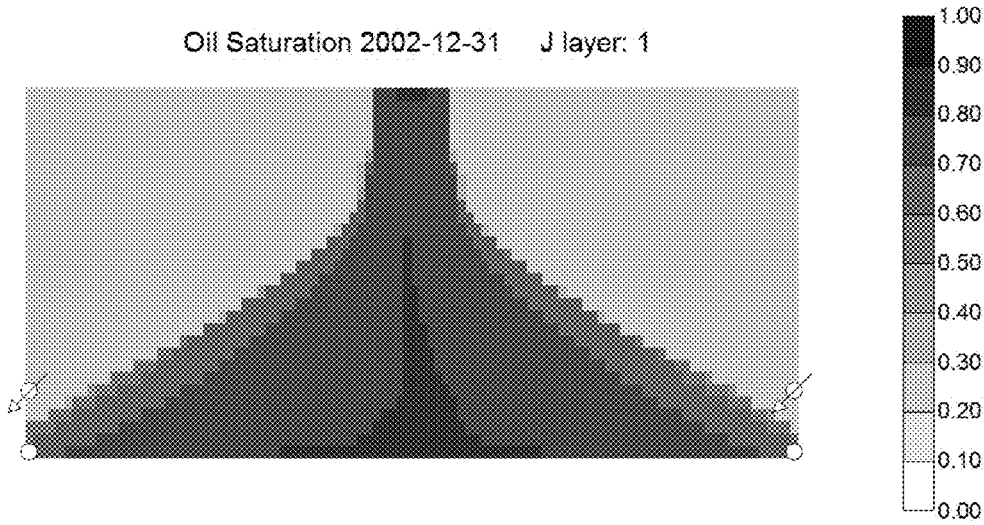
Figure 18A:
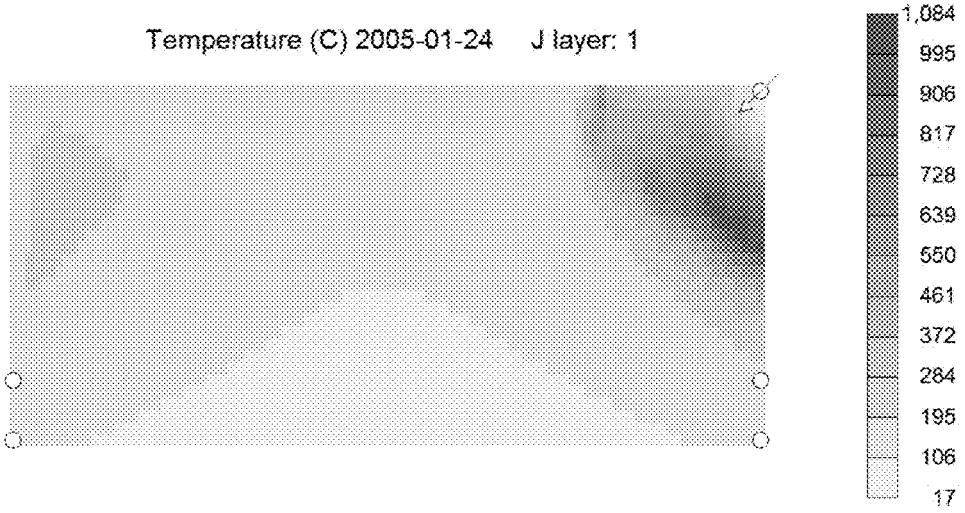
FIGS. 18A and 18B are sectional views through the reservoir illustrated in FIG. 3, which show the temperature and the oil saturation at a specific time during the modeled process.
Figure 18B:
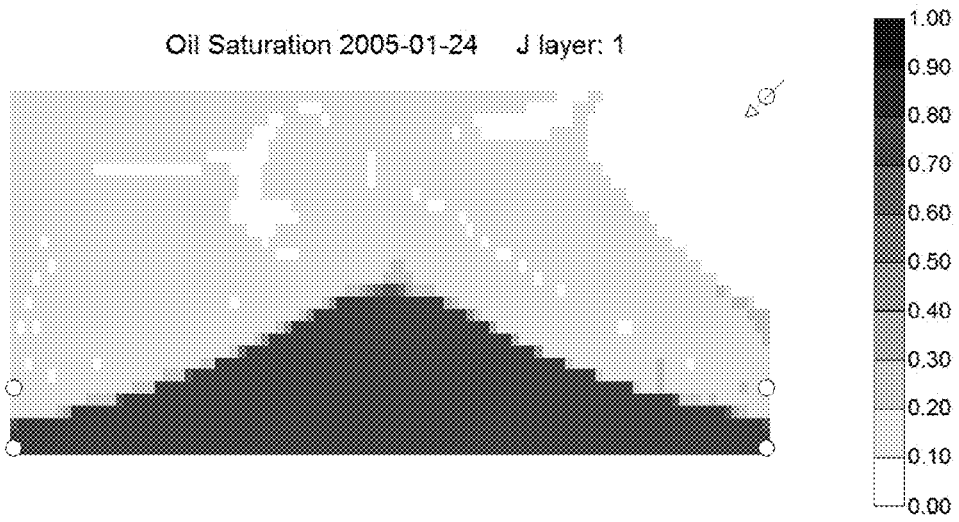
Figure 19A:
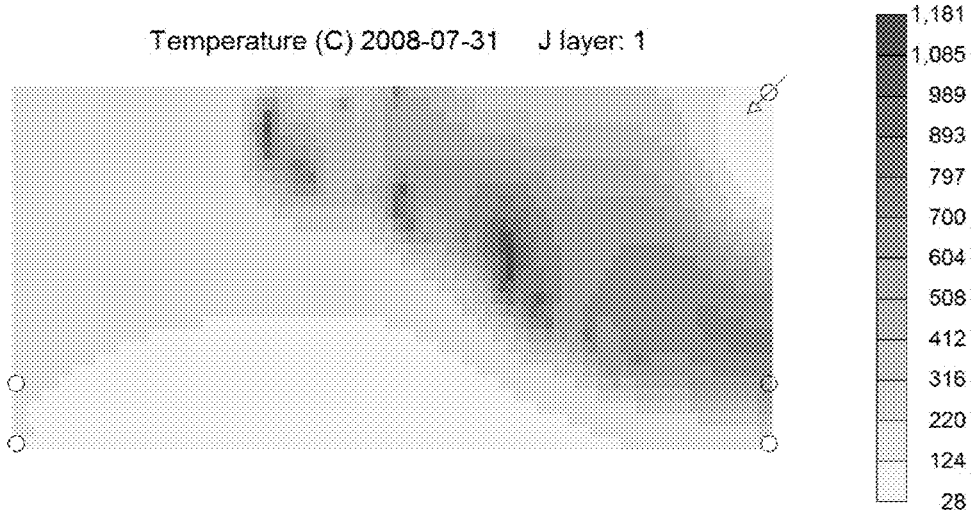
FIGS. 19A and 19B are sectional views through the reservoir illustrated in FIG. 3, which show the temperature and the oil saturation at a specific time during the modeled process.
Figure 19B:
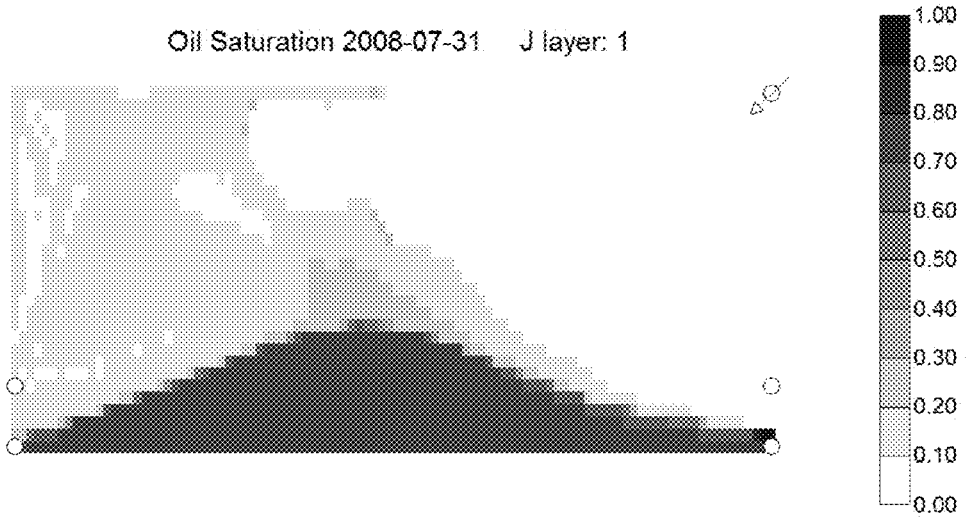
Figure 20A:
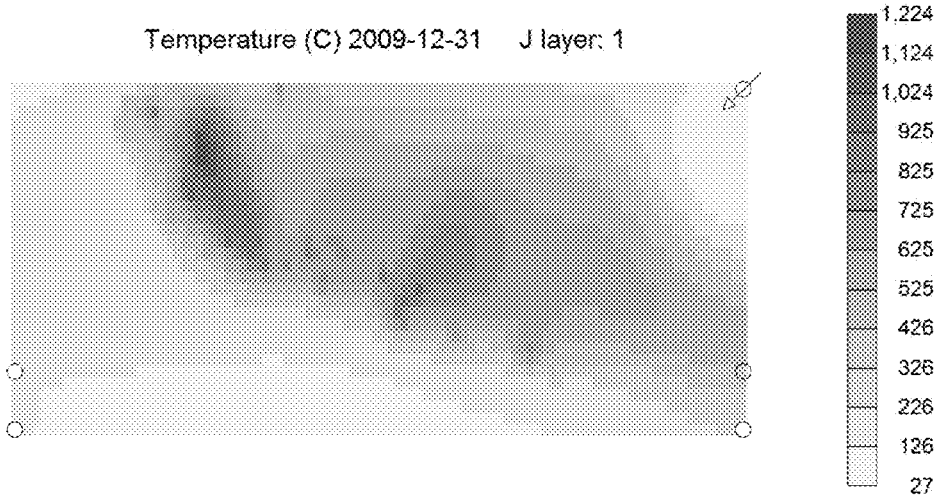
FIGS. 20A and 20B are sectional views through the reservoir illustrated in FIG. 3, which show the temperature and the oil saturation at a specific time during the modeled process.
Figure 20B:
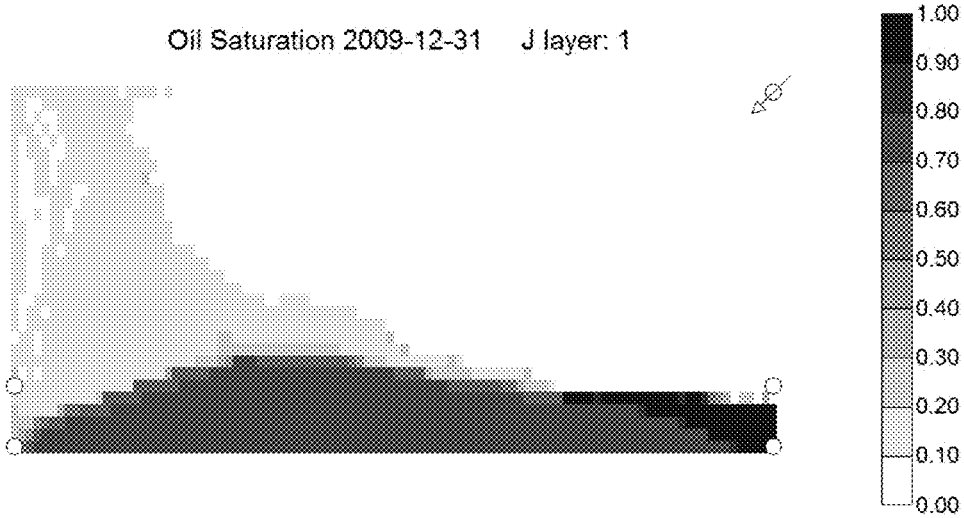
Figure 21A:
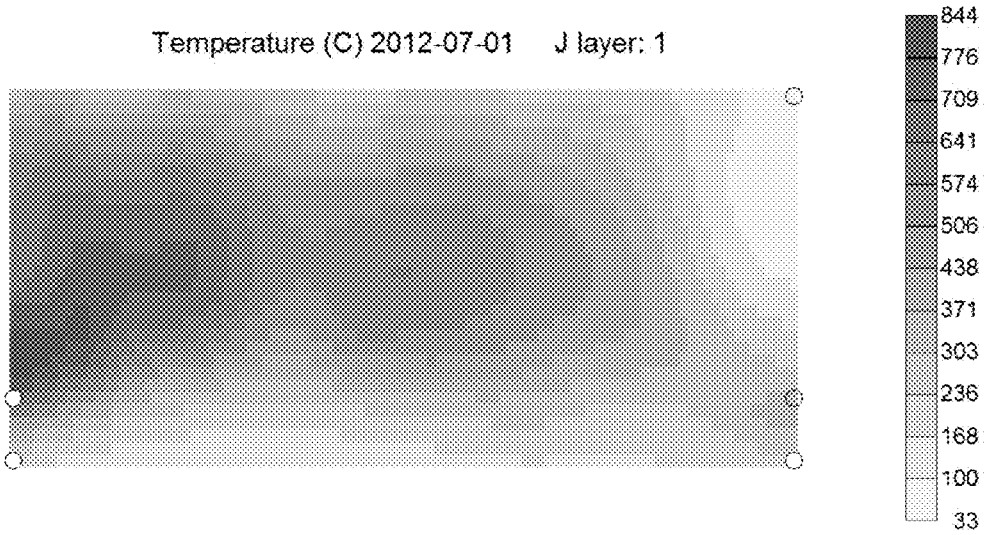
FIGS. 21A and 21B are sectional views through the reservoir illustrated in FIG. 3, which show the temperature and the oil saturation at a specific time during the modeled process.
Figure 21B:
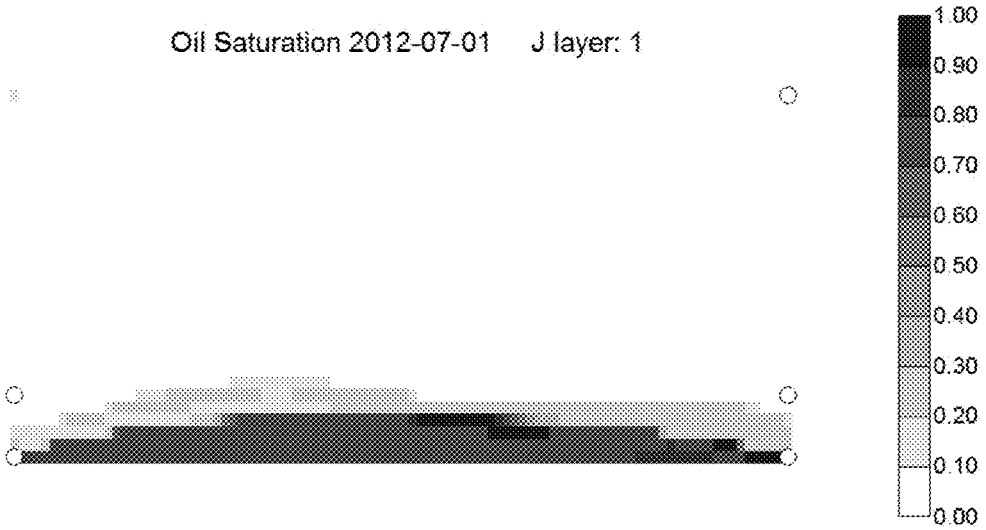
Figure 22A:
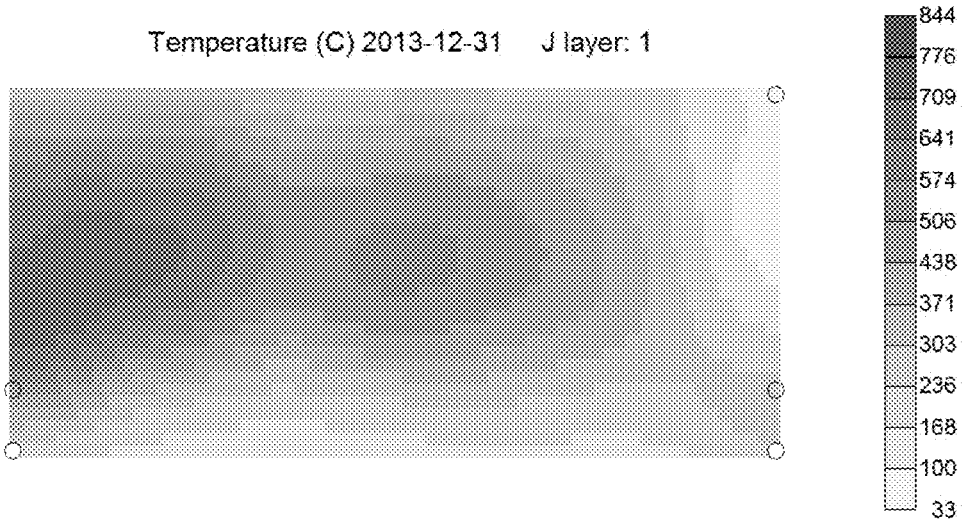
FIGS. 22A and 22B are sectional views through the reservoir illustrated in FIG. 3, which show the temperature and the oil saturation at a specific time during the modeled process.
Figure 22B:
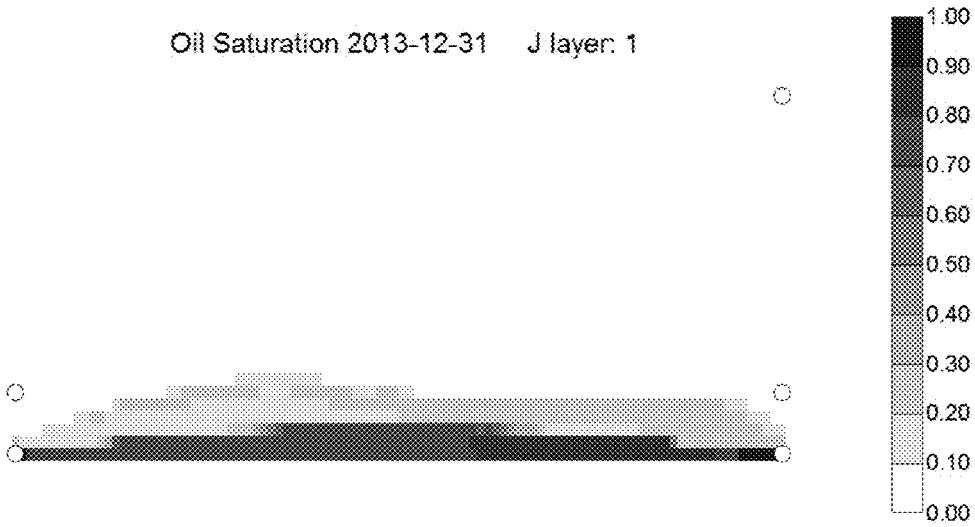

FIG. 16 illustrates the temperature at day 1095 (Dec. 31, 2002). FIGS. 17-22 illustrate (A) the temperature and (B) the oil saturation at progressively later times during the simulation (Dec. 31, 2002; Jan. 24, 2005; Jul. 31, 2008; Dec. 31, 2009; Jul. 1, 20012; and Dec. 31, 2013, respectively).

Figure 23:
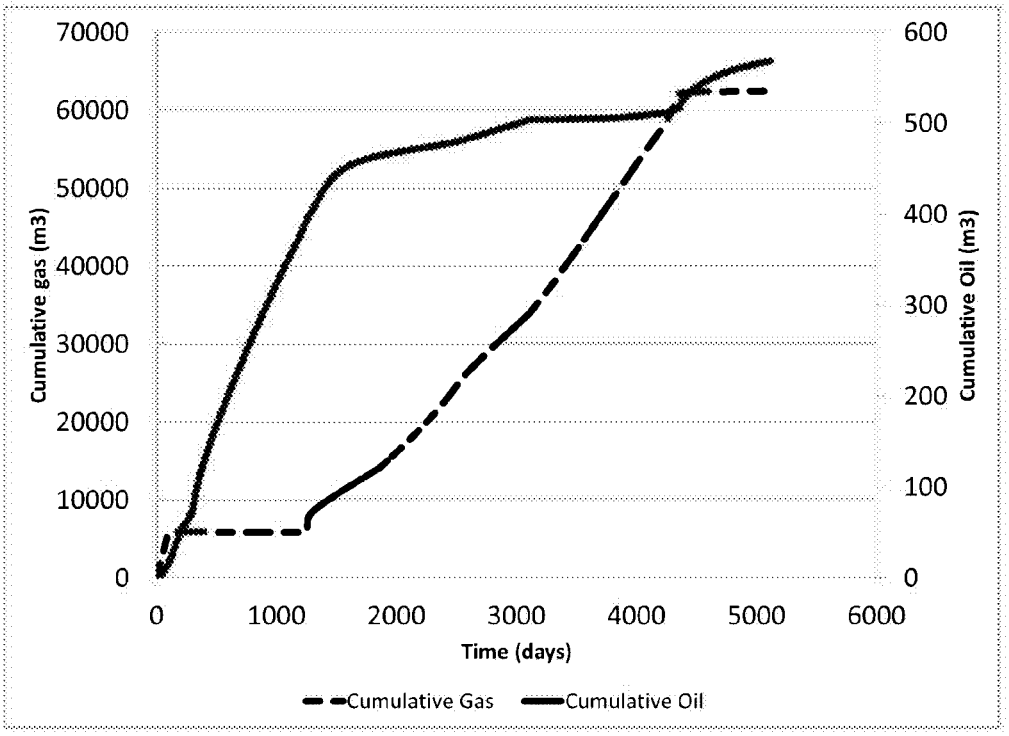
FIG. 23 is a is a graph showing the cumulative oil and gas production.

FIG. 23 is a graph illustrating cumulative oil and gas production.

Figure 24:
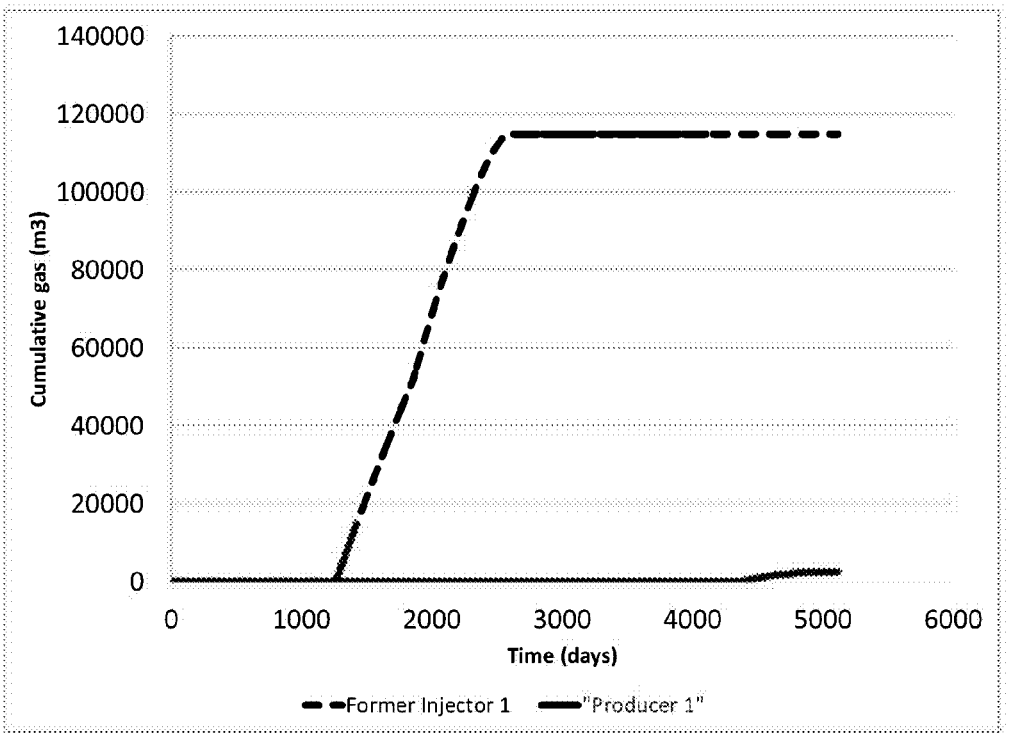
FIG. 24 is a graph showing the cumulative gas production in the former SAGD producer well and in the former steam injector well.

FIG. 24 is a graph showing the cumulative gas production in the former SAGD producer well and in the former steam injector well. This figure illustrates that the gas is being produced from the former steam injection well during the in situ combustion process and is not being substantially produced from the former SAGD producer well. That is, the former steam injection well has been converted into a combustion gas venting well.

Figure 25:
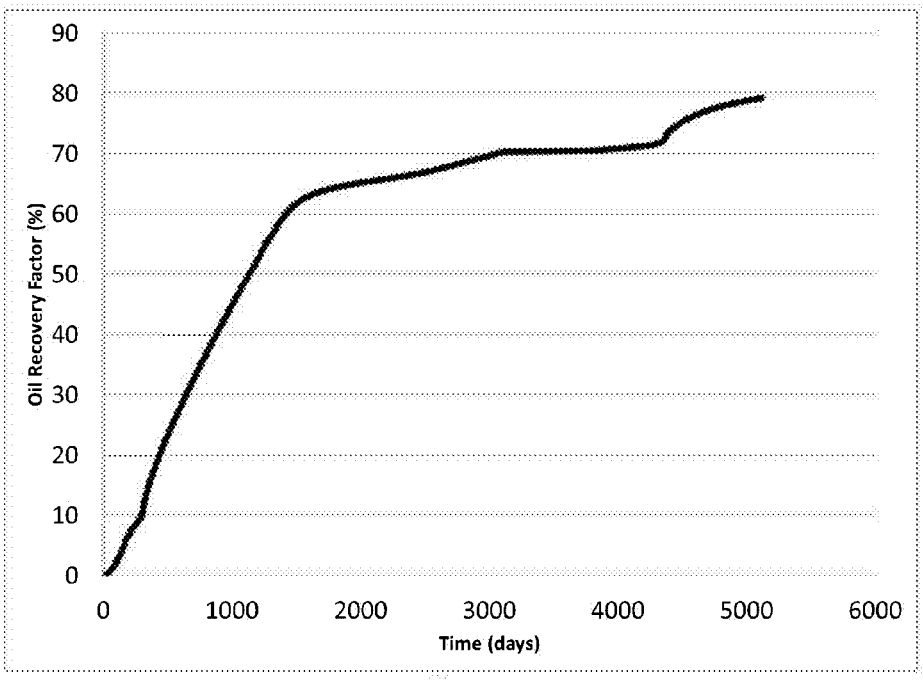
FIG. 25 is a graph showing the percentage of oil recovered from the reservoir.

FIG. 25 is a graph showing the percent of the oil recovered from the reservoir.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A process for hydrocarbon recovery from an oil sands reservoir comprising:

performing a steam assisted gravity drainage operation by:

injecting steam in a steam injection well of a steam assisted gravity drainage well pair and continuing to inject steam to establish fluid communication between the steam injection well and an oxidizin as injection well that includes an oxidizin as injection well segment that is spaced generally above the steam injection well segment;

producing hydrocarbons from a hydrocarbon production well of the steam assisted gravity drainage well pair, the hydrocarbon production well including a generally horizontal production well segment disposed generally parallel to and vertically below a generally horizontal steam injection well segment of the steam injection well such that the steam injection well segment is disposed generally vertically between the production well segment and the oxidizing gas injection well segment;

in response to determining that the steam injected in the steam injection well reaches the oxidizing gas injection well or is near a top of the oil sands reservoir, discontinuing performing steam assisted gravity drainage;

injecting an oxidizing gas into the oil sands reservoir through the oxidizing gas injection well, the oxidizing gas supporting in situ combustion in the reservoir; and utilizing the steam assisted gravity drainage well pair to recover hydrocarbons mobilized by the in situ combustion, by:

producing combustion gases through steam injection well of the steam assisted gravity drainage well pair; and recovering the mobilized hydrocarbons from the reservoir through the hydrocarbon production well of the steam assisted gravity drainage well pair.

2. The process according to claim 1, wherein the oxidizing gas injection well segment of the oxidizing gas injection well is disposed at an angle that is less than 75° from a vertical line extending through the hydrocarbon production well and at an angle that is less than 75° from a vertical line extending through the steam injection well.

3. The process according to claim 1, wherein the oxidizing gas injection well segment of the oxidizing gas injection well is disposed at an angle that is less than 60° from a vertical line extending through the hydrocarbon production and at an angle that is less than 60° from a vertical line extending through the steam injection well.

4. The process according to claim 1, wherein the oxidizing gas injection well segment of the oxidizing gas injection well is disposed at an angle that is less than 45° from a vertical line extending through the hydrocarbon production well and at an angle that is less than 45° from a vertical line extending through the steam injection well.

5. The process according to claim 1, wherein the oxidizing gas injection well segment of the oxidizing gas injection well is disposed directly vertically above and parallel with the generally horizontal hydrocarbon production well segment of the hydrocarbon production well and directly vertically above the generally horizontal steam injection well segment of the steam injection well.

6. The process according to claim 5, wherein the oxidizing gas injection well segment of the oxidizing gas injection well is disposed at an angle that is less than 5° from a vertical line extending through the hydrocarbon production well and at an angle that is less than 5° from a vertical line extending through the steam injection well.

7. The process according to claim 1, wherein the oxidizing gas injection well segment is generally horizontal and extends generally parallel to the generally horizontal hydrocarbon production well segment of the hydrocarbon production well and the generally horizontal steam injection well segment of the steam injection well.

8. The process according claim 1, wherein the vertical distance between the oxidizing gas injection well segment and the generally horizontal segment of the combustion gas production well is greater than the vertical spacing between the generally horizontal steam injection well segment of the steam injection well and the generally horizontal hydrocarbon production well segment of the hydrocarbon production well.

9. The process claim 1, wherein a steam chamber provides fluid communication for the steam assisted gravity drainage well pair and the oxidizing gas injection segment.

10. The process according to claim 9 wherein the steam chamber is a steam-assisted gravity drainage-produced steam chamber.

* * * * *